US006056708A

United States Patent [19]

Sayama et al.

[11] Patent Number: 6,056,708

[45] Date of Patent: May 2, 2000

[54] MASSAGING APPARATUS HAVING FRAME WITH OPENING AND A COVER STRETCHED OVER FRAME

[75] Inventors: Naoto Sayama, Shioya-gun; Makoto Fukutani, Hikone, both of Japan

[73] Assignees: Matsushita Electric Works, Ltd., Osaka; TS Tech Co., Ltd., Saitama, both of Japan

[21] Appl. No.: 09/147,344

[22] PCT Filed: Apr. 28, 1998

[86] PCT No.: PCT/JP98/01961

§ 371 Date: Dec. 4, 1998

§ 102(e) Date: Dec. 4, 1998

[87] PCT Pub. No.: WO98/48762

PCT Pub. Date: Nov. 5, 1998

[30] Foreign Application Priority Data

Apr. 30, 1997 [JP] Japan ..... 9-113087

[51] Int. Cl.[7] ..... A61H 15/00

[52] U.S. Cl. ..... 601/99; 601/100; 601/102; 601/116

[58] Field of Search ..... 601/49, 51–54, 601/56–65, 86, 87, 90, 98–103, 115, 116; 5/402, 403; 297/452.18, 452.56, 440.11

[56] References Cited

U.S. PATENT DOCUMENTS

| | | |
|---|---|---|
| 4,886,051 | 12/1989 | White . |
| 4,915,448 | 4/1990 | Morgenstern . |
| 5,836,645 | 11/1998 | Sakaue et al. . |

FOREIGN PATENT DOCUMENTS

| | | | |
|---|---|---|---|
| 1293773 | 4/1962 | France | 297/452.56 |
| 59-197249 | 11/1984 | Japan . | |
| 4-138158 | 5/1992 | Japan . | |
| 404317607 | 11/1992 | Japan | 297/452.18 |
| 7-136227 | 5/1995 | Japan . | |
| 8-154987 | 6/1996 | Japan . | |
| WO98/48763 | 11/1998 | WIPO . | |

*Primary Examiner*—Danton D. DeMille
*Attorney, Agent, or Firm*—Arent Fox Kintner Plotkin & Kahn, PLLC

[57] ABSTRACT

A massaging device having a massaging mechanism which is incorporated in a supporting structure of a user's body for applying a massage action from an applicator to the user's body. The supporting structure has a frame with an opening within which the applicator is located to give the massage action through a cover sheet stretched over the frame. The frame has a pair of side members which define therebetween the opening and are connected to opposite ends of the cover sheet. The ends of the cover sheet are each bifurcated to have a pair of outer and inner extensions provided respectively with outer and inner catches. Each side member is formed on its rear surface with a pair of outer and inner hooks for detachable engagement respectively with the outer and inner catches. The inner and outer hooks are located respectively on the rear surface of the side member at an inner end thereof adjacent to the opening and at the outer end of the rear surface remote from the opening, so that only the outer extension extends across a front surface of the side member when the outer and inner catches are engaged respectively with the outer and inner hooks. Since the cover sheet covering the opening of the frame is detachably connected to the side members of the frame by the outer and inner catches provided at the opposite ends of the cover sheet, attachment and replacement of the over sheet can be easily made without the necessity of a tool.

2 Claims, 3 Drawing Sheets

MASSAGING APPARATUS HAVING FRAME WITH OPENING AND A COVER STRETCHED OVER FRAME

TECHNICAL FIELDS

The present invention relates to a massaging device of a type incorporating a massaging mechanism in a chair's backrest or in a bed.

BACKGROUND ART

In a massaging device of the type incorporating a massaging mechanism in a chair's backrest or in a bed, particularly in the massaging device in which an applicator moves along the backrest to give a massaging action, the massaging action is transmitted from the applicator to a user through a cover sheet which covers the backrest or bed in order to avoid direct contact of the applicator to the user's body. In this case, the cover sheet is conventionally fastened to a frame of the backrest or the bed by driving staples through the cover into the frame. However, in addition to that the fastening work necessitates a special tool for driving the staples, the frame is required to have a thickness greater than the length of the staples in order to safely drive the staples and assure a desired fastening strength. Further, the replacement of the cover sheet involves an awkward work of removing the staples.

The present invention has been accomplished in view of the above and provides a massaging device which is capable of attaching and replacing a cover sheet in a convenient manner, while using the frame of a thin and light weight construction.

DISCLOSURE OF THE INVENTION

A massaging device of the present invention includes a frame which defines a supporting structure which supports a user's body and incorporates a mechanism of actuating an applicator for applying a massaging action to the user's body. The frame includes a pair of side members defining therebetween an opening within which the applicator is disposed. A cover sheet stretches over the opening and connected at opposite ends thereof to the side members respectively such that the applicator applies the massaging action to the user's body through the cover sheet. The cover sheet is bifurcated at each of its opposite sides to have a pair of outer and inner extensions provided respectively with outer and inner catches. Each of the side members is formed on its rear surface with a pair of outer and inner hooks for detachable engagement respectively with the outer and inner catches at each of the opposite sides of the sheet cover. The inner and outer hooks are located respectively at an inner end of the rear surface of the side member adjacent to the opening and at the outer end of the rear surface of the side member remote from the opening, so that only the outer extension extends across a front surface of the side member when the outer and inner catches are engaged respectively with the outer and inner hooks.

Since the cover sheet covering the opening of the frame is detachably connected to the side members of the frame by the outer and inner catches provided at the opposite ends of the cover sheet, attachment and replacement of the cover sheet can be easily made without the necessity of a tool. Further, since the outer and inner catches are engaged respectively with the outer and inner hooks formed on the rear surface of the side member at positions remote and adjacent to the opening, the ends of the cover sheet can be held firmly at the inner catches even when the cover sheet is caused to flex forwardly upon receiving a force of the applicator during the massaging action. Whereby, the outer extension leading to the outer catches can be prevented from being pulled away from the front surface of the side member of the frame.

Preferably, the cover sheet is formed with a sag extending in parallel with the side member so that the sag can eliminate an excess tension from being developed in the cover sheet which would otherwise develop due to a force exerted by the applicator.

These and still other advantages of the present invention will become apparent from the following description of the preferred embodiment when taken in conjunction with the attached drawings.

BEST MODES FOR CARRYING OUT THE INVENTION

Figure 1:
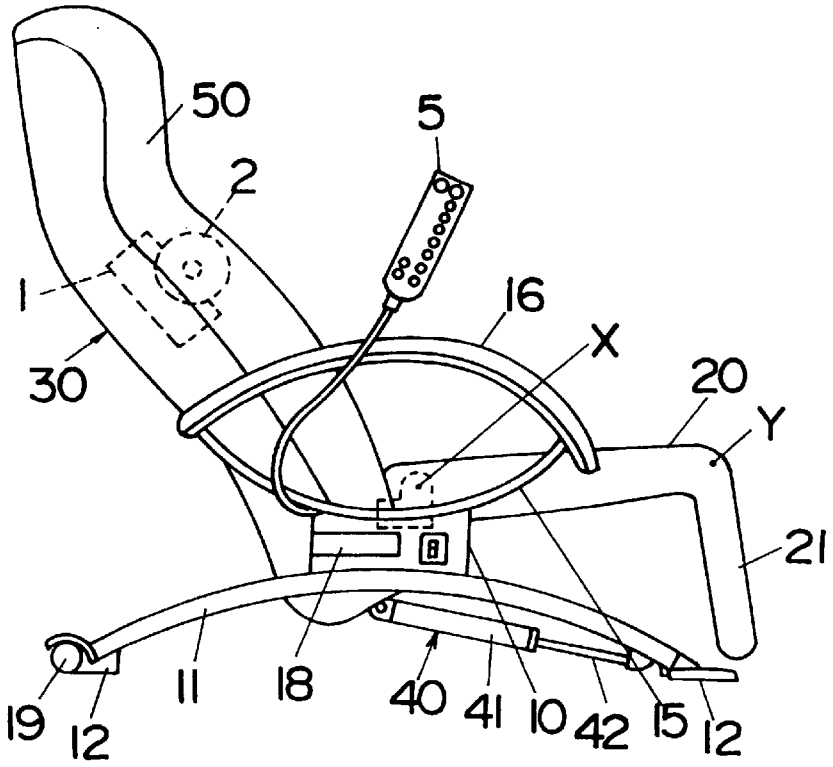
FIG. 1 is a side view of a massaging device in accordance with one embodiment of the present invention.
Figure 2:
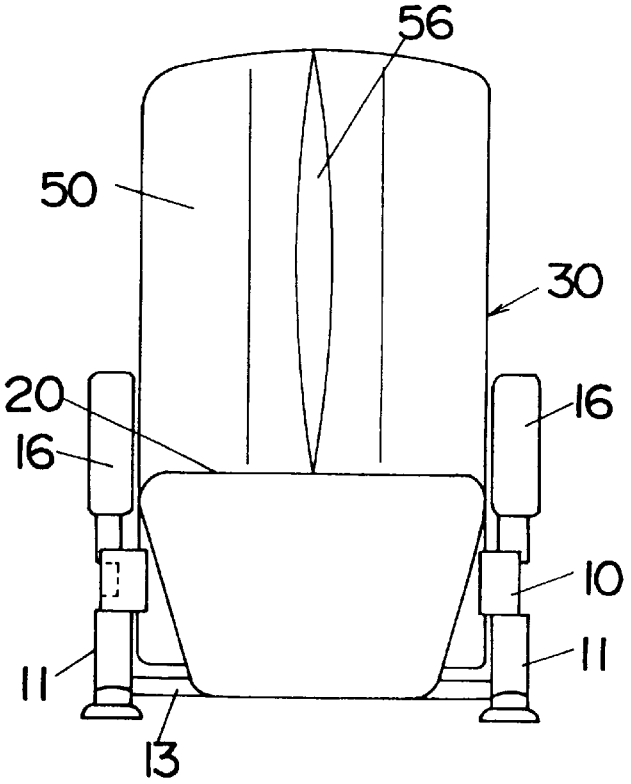
FIG. 2 is a front view of the massaging device.

FIG. 1 illustrates a chair-type massaging device in accordance with a preferred embodiment of the present invention, which has chair's backrest 30 mounting therein a massaging mechanism 1 with an applicator 2. The massaging device includes a base 10 with a pair of legs 11, and a combination of a seat 20 and the backrest 30 mounted to the base 10. The seat 20 and the backrest 30 are integrally secured and is pivotally supported to the base 10 to be rotatable about a pivot axis X. Each of the legs 11 is shaped into an upwardly convexed arcuate configuration and is provided at its opposite ends with foot stands 12 and is provided at its rear end with a wheel 19 for transportation of the device. The legs 11 are connected at their front ends by a crossbar 13 which is connected to the backrest 30 by means of a reclining mechanism 40. The reclining mechanism 40 comprises a gas-filled cylinder 41 and an extensible plunger 42 extending from the cylinder 41. The plunger 42 has its one end connected to the crossbar 13 at the front end of the legs 11, while the cylinder 41 has its one end connected to the lower end of the backrest 30. The reclining mechanism 40 includes an actuator (not shown) which, upon being actuated, opens an internal valve of the cylinder 41 to permit a filled gas to move within the cylinder 41 and therefore permit the plunger 42 to move relative to the cylinder 41. Thus, the backrest 30 can be angled in accordance with a load applied to the backrest so that the backrest 30 can rotate together with the seat 20 in a reclining manner. Projecting from the front end of the seat 20 is a foot stand 21 which is rotatable about a pivot axis Y.

Figure 3:
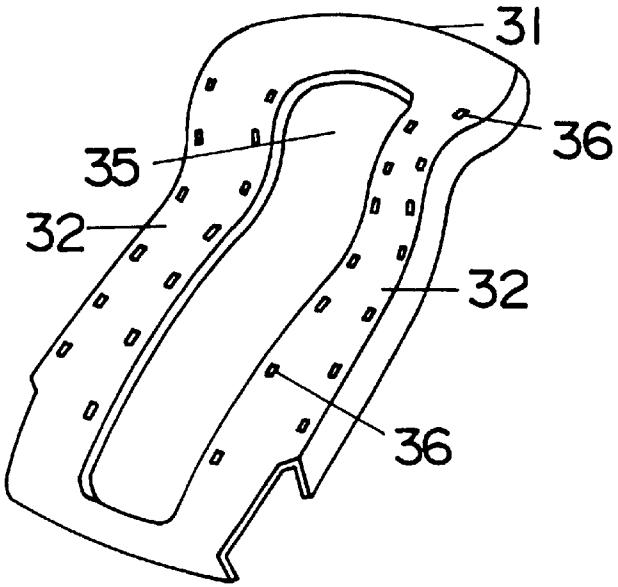
FIG. 3 is a perspective view of a frame for a backrest of the massaging device.
Figure 4:
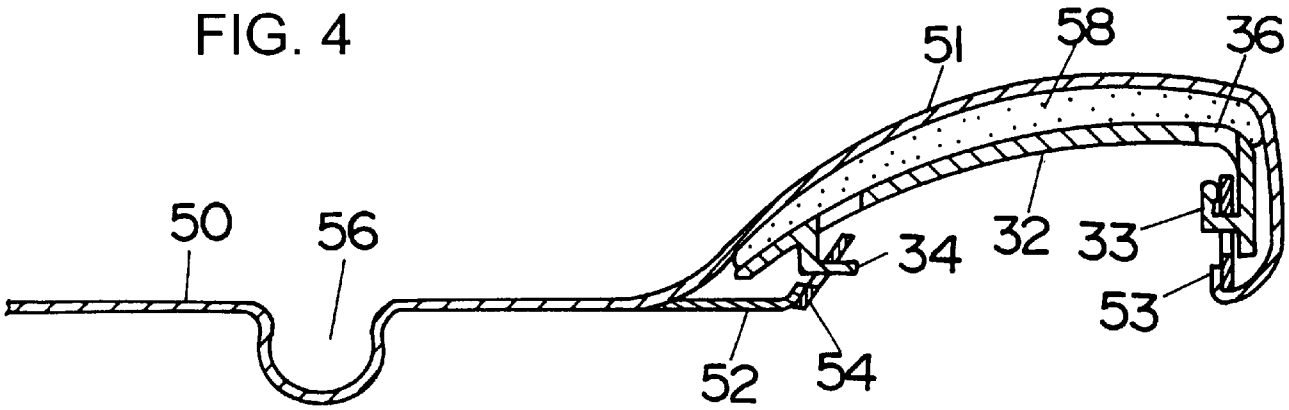
FIG. 4 is a partially sectional view of a connection between the frame and a cover sheet thereof.
Figure 5:
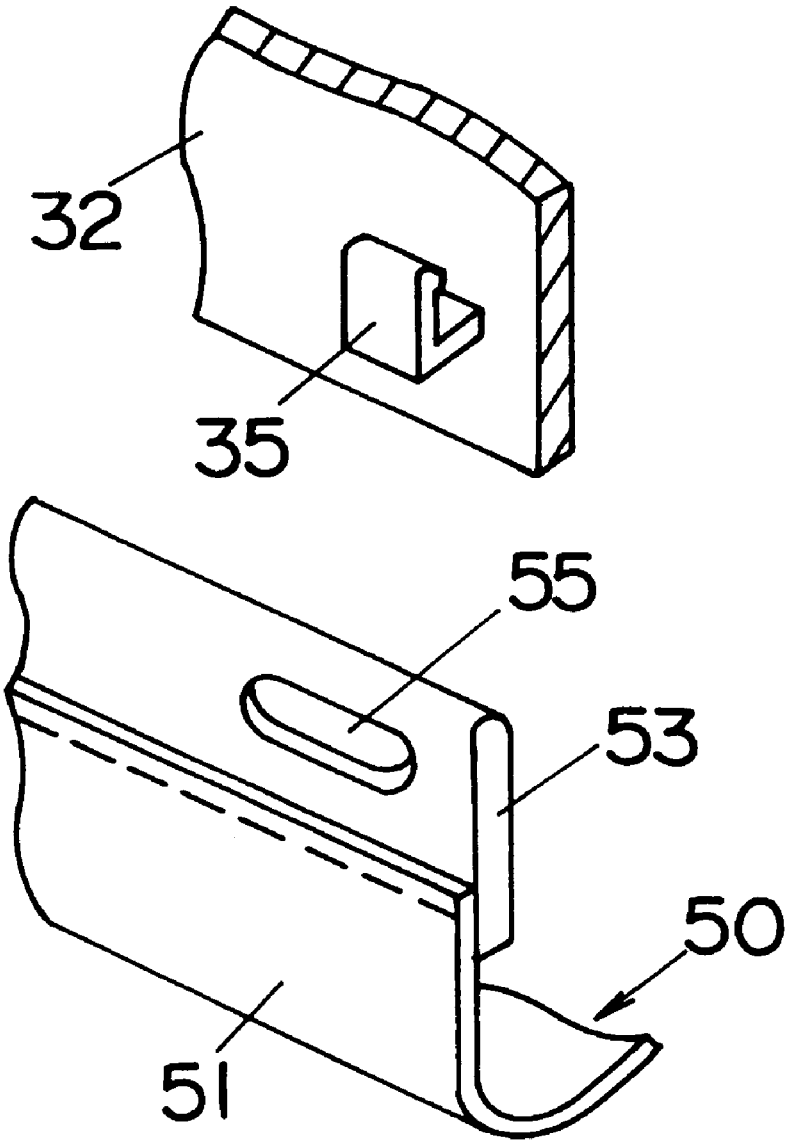
FIG. 5 is an exploded perspective partial view of a hook of the frame and a catch in the cover sheet.

Secured to the seat 20 on opposite sides thereof are supporting members 15 of arcuate configuration which support armrests 16 of upwardly convexed arcuate configuration. The base 10 has a recess 18 for receiving a controller 5 which operates the massaging mechanism in a position attached within the recess or in a position detached therefrom. As shown in FIG. 3, the backrest 30 of the chair-type massaging device has a plastic molded frame 31 of which front face is covered with a fabric made cover sheet 50 to define a supporting structure for the user's back. It is within this supporting structure that the massaging mechanism is mounted. The frame 31 has a pair of side members 32 which are connected to each other at upper and lower ends thereof to define an opening 35 between the side members 32. The applicator 2 of the massaging mechanism 1 is disposed within the opening 35 to apply the massaging action through the cover sheet 50 to the back of the user. As shown in FIG. 4, the cover sheet 50 has its opposite ends each bifurcated to give an outer extension 51 and an inner extension 52 shorter than the outer extension 51. Stitched respectively to the ends of the outer and inner extensions are plastic made outer and inner catches 53 and 54 each formed with a plurality of holes 55. The outer extension 51 extends continuously as an integral part of the cover sheet 50, while the inner extension 52 is stitched to the cover sheet 50.

As shown in the figure, the side members 32 of the frame 31 are each formed on its rear surface with outer hooks 33 and inner hooks 34 both arranged along the length of the side member. The outer hooks 33 are formed on the rear surface of the side member 32 at locations remote from the opening 35, while the inner hooks 34 formed on the rear surface of the side member 32 adjacent to the opening 35. Numeral 36 in the figure shows holes left as a result of forming the outer and inner hooks. By engagement of the outer and inner hooks 33 and 34 into the holes 55 of the outer and inner catches 53 and 54, the outer extension 51 alone covers the front surface of the side member 32. Numeral 58 indicates a cushion held between the outer extension 51 and the front surface of the side member 32 of the frame 31.

Thus, the cover sheet 50 can be easily attached or replaced simply by engaging the hooks 33 and 34 with the catches 53 and 54 stitched to the cover sheet 50 without requiring a tool. It should be noted that the hooks 33 and 34 as well as the catches 53 and 54 are not limited to the illustrated configuration and may be of any other detachable configurations. Further, it is also possible to provide the hooks on the side of the cover sheet and catches on the side of the frame.

The cover sheet 50 is formed at its center with a sag 56 which extends in parallel with the side members in order to relieve a stress applied to the cover sheet from the applicator of the massaging mechanism for avoiding an excess force from applying to the connections between the cover sheet and the frame.

The above embodiment discloses to use the hooks and the catches for connection of the frame of the backrest with the cover sheet, it is equally possible to use the same configuration structure for connection of a frame of the seat and a cover sheet thereof.

We claim:

1. A massaging device which comprises:

a frame which defines a supporting structure on which a user's body is placed, said supporting structure incorporating a mechanism of actuating an applicator for applying a massaging action to a user's body, said frame including a pair of side members defining therebetween an opening within which said applicator is disposed; and a cover sheet stretched over said opening and connected at opposite sides thereof to said side members respectively such that said applicator applies the massaging action to the user's body through said cover sheet;

said cover sheet being bifurcated at each of the opposite ends thereof to have a pair of outer and inner extensions provided respectively with outer and inner catches;

each of said side members being formed on its rear surface with a pair of outer and inner hooks for detachable engagement respectively with said outer and inner catches at each of said opposite sides of said cover, said inner and outer hooks being located respectively at an inner end of said rear surface of said side member adjacent to said opening and at an outer end of said rear surface remote from said opening so that only said outer extension extends across a front surface of said side member when said outer and inner catches are engaged respectively with said outer and inner hooks.

2. The massaging device as set forth in claim 1, wherein said cover sheet is formed with a sag extending in parallel with said side members.

* * * * *